US009972430B2

(12) United States Patent
Park et al.

(10) Patent No.: US 9,972,430 B2
(45) Date of Patent: May 15, 2018

(54) COIL COMPONENT

(71) Applicant: SAMSUNG ELECTRO-MECHANICS CO., LTD., Suwon-Si, Gyeonggi-Do (KR)

(72) Inventors: Seung Wook Park, Suwon-Si (KR); Kwang Mo Kim, Suwon-Si (KR); Won Chul Sim, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days. days.

(21) Appl. No.: 14/937,227

(22) Filed: Nov. 10, 2015

(65) Prior Publication Data

US 2016/0225513 A1 Aug. 4, 2016

(30) Foreign Application Priority Data

Jan. 27, 2015 (KR) ..... 10-2015-0012734

(51) Int. Cl.
*H01F 5/00* (2006.01)
*H01F 17/00* (2006.01)
*H01F 27/29* (2006.01)

(52) U.S. Cl.
CPC ..... *H01F 17/0013* (2013.01); *H01F 27/292* (2013.01)

(58) Field of Classification Search
CPC ..... H01F 27/2804; H01F 27/24; H01F 27/29; H01F 17/0006
USPC ..... 336/200, 223, 233, 192
See application file for complete search history.

(56) References Cited

U.S. PATENT DOCUMENTS 5,393,603 A * 2/1995 Toyoda ..... B32B 27/20 428/308.8
8,174,349 B2 * 5/2012 Yoshida ..... H01F 27/292 257/700
2010/0052838 A1 * 3/2010 Matsuta ..... H01F 17/0013 336/200
2013/0009740 A1 * 1/2013 Chang ..... H01F 41/04 336/200
2013/0052439 A1 2/2013 Kim et al.
(Continued)

FOREIGN PATENT DOCUMENTS

JP 2005-129793 A 5/2005
JP 2009-239770 A 10/2009
(Continued)

OTHER PUBLICATIONS

Korean Office Action dated Nov. 26, 2015, issued in corresponding Korean patent application No. 10-2015-0012734. (w/ English translation).

*Primary Examiner* — Mangtin Lian
(74) *Attorney, Agent, or Firm* — McDermott Will & Emery LLP

(57) ABSTRACT

A coil component includes a magnetic substrate, an insulating layer provided on the magnetic substrate and having conductive coils formed in the insulating layer, and a reinforcing layer provided on the insulating layer and having a coefficient of thermal expansion lower than a coefficient of thermal expansion of the insulating layer. High attenuation characteristics and mountability of a coil component may be improved and the deviation of the coefficient of thermal expansion between the components may be alleviated.

10 Claims, 3 Drawing Sheets

(56) References Cited

U.S. PATENT DOCUMENTS

| | | | | |
|---|---|---|---|---|
| 2013/0076474 | A1* | 3/2013 | Chang | H01F 17/0013 336/200 |
| 2013/0234819 | A1* | 9/2013 | Yoo | H01F 17/0013 336/200 |
| 2014/0028430 | A1 | 1/2014 | Lee et al. | |

FOREIGN PATENT DOCUMENTS

| | | | | |
|---|---|---|---|---|
| JP | 2010-177380 | A | * | 8/2010 |
| JP | 2014-093341 | A | | 5/2014 |
| KR | 10-2013-0024506 | A | | 3/2013 |
| KR | 10-2014-0013590 | A | | 2/2014 |

* cited by examiner

COIL COMPONENT

CROSS-REFERENCE TO RELATED APPLICATION

This application claims the benefit of priority to Korean Patent Application No. 10-2015-0012734 filed on Jan. 27, 2015, with the Korean Intellectual Property Office, the disclosure of which is incorporated herein by reference.

BACKGROUND

The present disclosure relates to a coil component, and more particularly, to a coil component used as a noise filter.

In accordance with the development of consumer electronics, electronic devices such as portable phones, home appliances, personal computers (PCs), personal digital assistants (PDAs), liquid crystal displays (LCDs), and the like, have changed from using an analog scheme to a digital scheme, while the speed of electronic devices has been increased, due to increasing amounts of data required to be processed by electronic devices.

Therefore, universal serial bus (USB) 2.0, USB 3.0, and high-definition multimedia interface (HDMI) standards have been widely used in high speed signal transmitting interfaces, and have been used in many digital devices such as personal computers and digital high-definition televisions.

In such high speed interfaces, a differential signal system, in which differential signals (differential mode signals) are transmitted using a pair of signal lines, is adopted, unlike a single-end transmitting system that has generally been used for a long period of time. However, electronic devices that are digitized and have increased speeds are sensitive to external stimuli, such that distortion of signals due to high frequency noise is a common occurrence.

In order to remove such noise, a filter has been installed in electronic devices. Particularly, a common mode filter, a coil component for removing common mode noise, has been widely used in high speed differential signal lines, or the like.

Common mode noise is noise generated in differential signal lines, and common mode filters remove common mode noise that may not be removed by existing filters.

Meanwhile, as frequencies used in electronic products have gradually been increased, common mode filters having improved narrowband characteristics and attenuation characteristics in a high frequency band have been required. For instance, narrowband characteristics of about ±25% to ±20%, based on common mode impedance of 90Ω, high attenuation characteristics of −30 dB or more in a band of several GHz, and the like have been required.

Thus, in order to significantly reduce magnetic loss, a common mode filter having a structure in which a coil layer is directly exposed to air without a separate magnetic member such as a ferrite-resin composition layer has been suggested.

However, in this case, during a process of soldering mounting components, a problem in which mountability is deteriorated, for example, occurrence of a short circuit between electrodes, or the like, may occur.

In addition, deviations in a coefficient of thermal expansion between members forming the common mode filter, for example, a magnetic substrate and an insulating layer in contact with the magnetic substrate may be severe. As a result, defects such as warpage, or the like, may occur in the product itself.

SUMMARY

An aspect of the present disclosure may provide a coil component in which high attenuation characteristics are obtained, mountability is improved, and defects such as warpage, or the like do not occur.

According to an aspect of the present disclosure, a coil component may include a magnetic substrate formed of sintered ferrite, an insulating layer provided on the magnetic substrate and having a primary coil and a secondary coil formed in the insulating layer, and a reinforcing layer provided on the insulating layer and having a coefficient of thermal expansion lower than a coefficient of thermal expansion of the insulating layer.

The reinforcing layer may be formed of a non-magnetic polymer resin, or a mixture in which one or more of inorganic alumina ($Al_2O_3$), silica ($SiO_2$), and titanium oxide ($TiO_2$) fillers are dispersed in the polymer resin.

According to another aspect of the present disclosure, a coil component may include external electrodes for external electrical connectivity. The external electrodes may be formed on an upper outer surface of an insulating layer, or may be formed on lateral surfaces of a multilayer body including a magnetic substrate, the insulating layer, and a reinforcing layer.

When the external electrodes are formed on the upper outer surface of the insulating layer, the reinforcing layer may be inserted into an empty space between the external electrodes.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
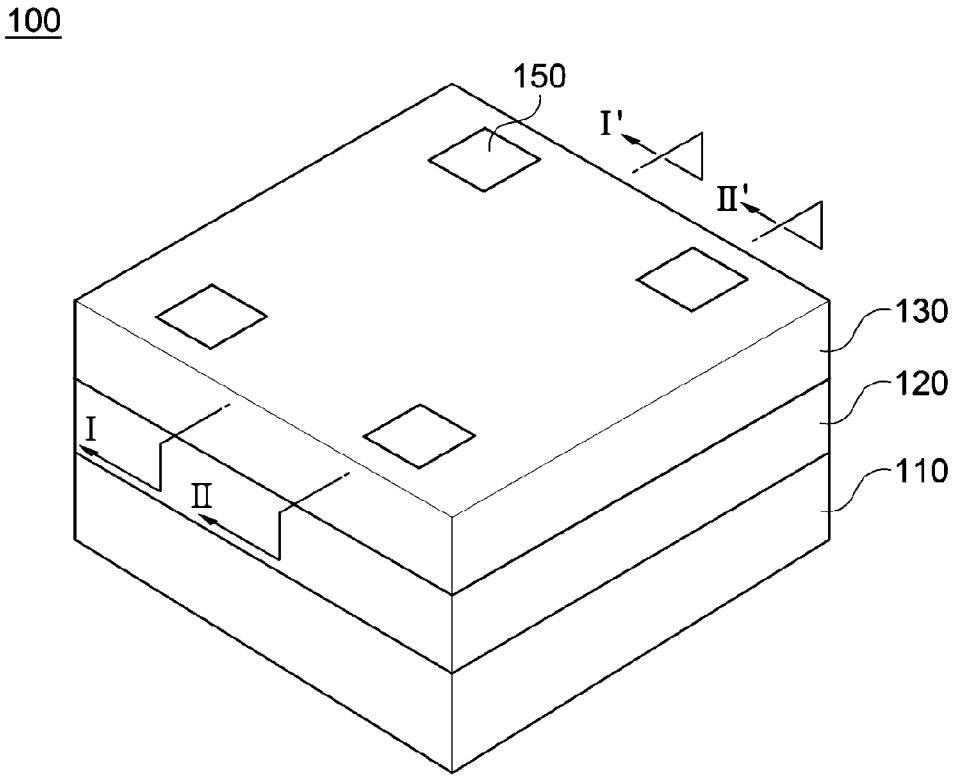
FIG. 1 is a perspective view of a coil component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
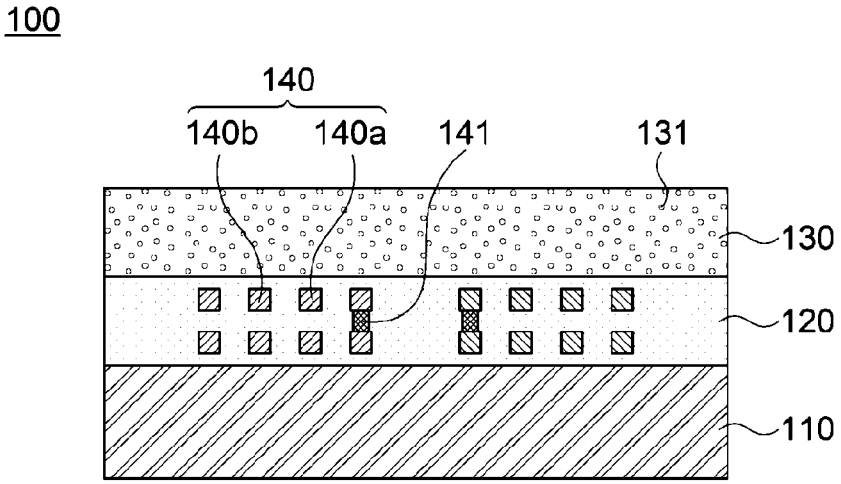
FIG. 2 is a cross-sectional view taken along line I-I' of FIG. 1.
Figure 3:
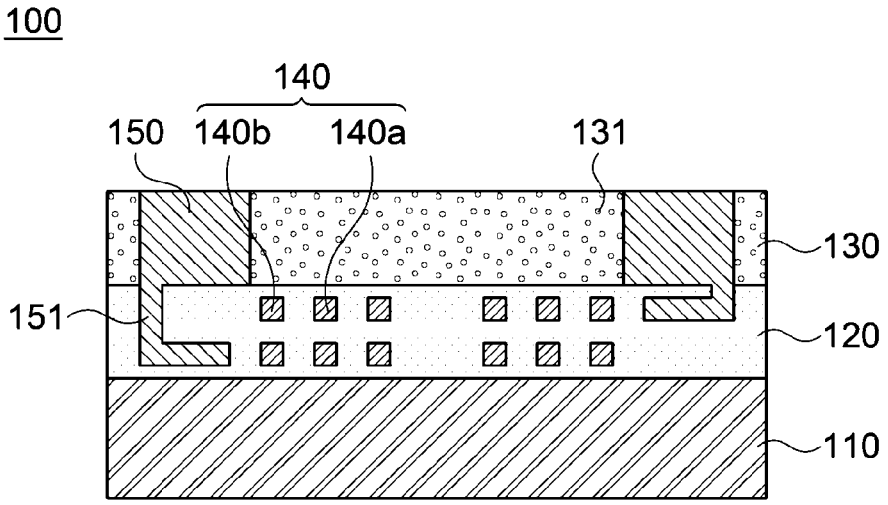
FIG. 3 is a cross-sectional view taken along line II-II' of FIG. 1.

FIG. 1 is a perspective view of a coil component according to an exemplary embodiment in the present disclosure, FIG. 2 is a cross-sectional view taken along line I-I' of FIG. 1, and FIG. 3 is a cross-sectional view taken along line II-II' of FIG. 1.

Referring to FIGS. 1 through 3, a coil component 100 according to an exemplary embodiment in the present disclosure may include a magnetic substrate 110, an insulating layer 120, and a reinforcing layer 130.

The magnetic substrate 110, which is a support body of a plate shape formed of a ceramic material, may be disposed on the lowermost portion of the coil component 100, and the insulating layer 120 and the reinforcing layer 130 may be sequentially laminated on the magnetic substrate 110. For instance, the present disclosure relates the coil component in which a multilayer body including the magnetic substrate 110, the insulating layer 120, and the reinforcing layer 130 as basic components is one unit element, and the multilayer body may be formed as a an approximately 0403-sized rectangular parallelepiped.

In addition, the magnetic substrate 110 may serve as a path for magnetic flux generated at the time of applying a current to the coil component 100.

Thus, the magnetic substrate 110 may be formed of any magnetic material as long as it may obtain a predetermined degree of inductance. For example, the magnetic substrate 110 may be formed of one or more magnetic materials selected from a Ni-based ferrite material containing $Fe_2O_3$ and NiO as main components, a Ni—Zn-based ferrite material containing $Fe_2O_3$, NiO, and ZnO as main components, a Ni—Zn—Cu-based ferrite material containing $Fe_2O_3$, NiO, ZnO, and CuO as main components, and the like. In addition, a high modulus may be implemented by sintering the above-mentioned materials under a high temperature atmosphere.

The insulating layer 120 may be provided on the magnetic substrate 110, and conductive coils 140 may be formed in the insulating layer 120.

The conductive coils 140, metal wires having a coil shape formed on a plane, may be formed of at least one metal selected from a group consisting of silver (Ag), palladium (Pd), aluminum (Al), nickel (Ni), titanium (Ti), gold (Au), copper (Cu), or platinum (Pt) having excellent electrical conductivity.

The conductive coils 140 may be formed in multiple layers, and an electrical connection between the respective layers may be implemented through vias 141.

Here, the conductive coils 140 of each layer may form separate coils, respectively, for example, a primary coil 140*a* and a secondary coil 140*b*, which may be electromagnetically coupled to each other. Alternatively, as illustrated in the drawings, an electromagnetic coupling may be formed as a so-called simultaneous coil structure in which the primary coil 140*a* and the secondary coil 140*b* are alternately wired on one layer.

As such, the coil component 100 according to the present disclosure may be operated as a common mode filter (CMF) in which the primary coil 140*a* and the secondary coil 140*b* are electromagnetically coupled to each other, such that when currents flowing in the same direction are applied to the primary coil 140*a* and the secondary coil 140*b*, magnetic flux is added to increase common mode impedance, and when a current of the opposite direction is applied to the primary coil 140*a* and the secondary coil 140*b*, the magnetic flux is offset to decrease differential mode impedance.

The insulating layer 120 may surround the conductive coils 140 in all directions.

Specifically, the insulating layer 120 may be formed by first forming a base layer securing insulation properties with the magnetic substrate 110 and suppressing surface unevenness of the magnetic substrate 110 to provide flatness, and sequentially laminating the conductive coils 140 and a build-up layer covering the conductive coils 140 on the base layer. However, in a high temperature, high pressure laminating process, boundaries between the respective layers may not be separated and may be integrated as illustrated in the drawings.

As such, the insulating layer 120 may serve to protect the conductive coils 140 from external environmental factors such as humidity, heat, or the like while securing insulating properties between the wires by embedding the conductive coils 140 therein. Therefore, as a material forming the insulating layer 120, a polymer resin having excellent insulation properties, thermal resistance, and moisture resistance, for example, an epoxy resin, a phenol resin, a urethane resin, a silicon resin, a polyimide resin, or the like may be used.

However, since the polymer resin generally has a relatively high coefficient of thermal expansion (CTE) value of about 50 ppm/K or more, warpage may occur during a heat treatment process at a high temperature. In addition, since the magnetic substrate 110 formed of sintered ferrite exhibits a low coefficient of thermal expansion (CTE) of about 8 to 10 ppm/K as opposed to the insulating layer 120, delamination may occur at an interface between the magnetic substrate 110 and the insulating layer 120 due to deviation of the coefficient of thermal expansion (CTE) between two members.

This delamination may further become severe in a structure in which the magnetic substrate 110 is formed to be relatively thin to miniaturize the product or a separate ferrite member for implementing high attenuation characteristics is not present. Thus, the reinforcing layer 130 may be used as a means for preventing the above-mentioned delamination.

For instance, the reinforcing layer 130 may be provided on the insulating layer 120 and may have the coefficient of thermal expansion (CTE) lower than that of the insulating layer 120. As a result, the reinforcing layer 130 may alleviate a CTE mismatch between the magnetic substrate 110 and the insulating layer 120, and may serve as a stiffener preventing warpage of the insulating layer 120 together with the magnetic substrate 110.

Specifically, the coefficient of thermal expansion (CTE) of the reinforcing layer 130 may be set in the range of 20 to 30 ppm/K. For instance, the reinforcing layer 130 may have the coefficient of thermal expansion (CTE) lower than that of the insulating layer 120 and higher than that of the magnetic substrate 110. Here, in a case in which the coefficient of thermal expansion (CTE) of the reinforcing layer 130 is set to be too low, conversely, the CTE mismatch may occur between the insulating layer 120 and the reinforcing layer 130. Therefore, the reinforcing layer 130 may be formed of a material having the coefficient of thermal expansion (CTE) within the above-mentioned range.

The reinforcing layer 130 may be formed of a non-magnetic material, specifically, a dielectric having dielectric loss tangent of 0.3 or less. For example, as an optimal material forming the reinforcing layer 130, a polymer resin such as an epoxy resin, a phenol resin, a urethane resin, a silicon resin, a polyimide resin, or the like may be used.

Thus, even in the case that the magnetic flux generated at the time of applying the current to the coil component 100 passes through the reinforcing layer 130, magnetic loss may not occur. As a result, high attenuation characteristics may be implemented, even in a high frequency band.

A non-magnetic inorganic filler 131 may be contained to be dispersed in the reinforcing layer 130, and the coefficient of thermal expansion (CTE) of the reinforcing layer 130 may be adjusted by a content ratio of the inorganic filler 131.

For instance, the reinforcing layer 130 may be formed of a mixture of the polymer resin and the organic filler 131 having the coefficient of thermal expansion (CTE) of about 100 ppm/K, for example, alumina ($Al_2O_3$), silica ($SiO_2$), titanium oxide ($TiO_2$), or the like. Thus, by increasing the content ratio of the organic filler 131, the coefficient of thermal expansion (CTE) of the reinforcing layer 130 may be lowered.

However, in a case in which too much organic filler 131 is contained in the reinforcing layer 130, since a ratio of the resin may be reduced and weaken adhesion between the reinforcing layer 130 and the insulating layer 120, an appropriate amount of organic filler 131 needs to be used.

External electrodes 150 for external electrical connectivity may be formed on an upper outer surface of the insulating layer 120. The external electrode 150 may have a predetermined thickness and may be electrically connected to end portions of the conductive coils 140 through bump electrodes 151 in the insulating layer 120.

In detail, since the conductive coils 140 include the primary coil 140*a* and the secondary coil 140*b*, electromagnetically coupled to each other, the external electrodes 150 may include a total of four terminals such as a pair of external electrodes 150 connected to both end portions of the primary coil 140*a* and respectively serving as input and output terminals of the primary coil 140*a*, and a pair of external electrodes 150 connected to both end portions of the second coil 140*b* and respectively serving as input and output terminals of the secondary coil 140*b*. In addition, the respective external electrodes 150 may be disposed in the respective corner portions of the insulating layer 120 to be formed clockwise or counterclockwise from a left upper corner portion of the insulating layer 120.

In this structure, the reinforcing layer 130 may be inserted into an empty space between the external electrodes 150. For instance, the reinforcing layer 130 may have a thickness corresponding to the external electrodes 150. As a result, lateral surfaces of the external electrodes 150 may be surrounded by the reinforcing layer 130 and only upper surfaces of the external electrodes 150 may be exposed externally.

When the coil component 100 according to the present disclosure is mounted on a board, an upper surface of the reinforcing layer 130 may be provided as a mounting surface. Thus, solder balls may be attached to the upper surfaces of the external electrodes 150 exposed externally.

Here, since the reinforcing layer 130 is provided between the respective external electrodes 150, the present disclosure may prevent a solder bridge in which electrical shorts occur between the external electrodes 150 due to a solder solution. If a soldering process is performed in a state in which the lateral surfaces of the external electrodes 150 are all open without the reinforcing layer 130, the solder solution may flow into the empty space between the external electrodes 150, thereby causing electrical shorts.

As such, the reinforcing layer 130 may serve as a blocking layer insulating the respective external electrodes 150 in addition to having a function of alleviating deviations in the coefficient of thermal expansion (CTE). An effect of this reinforcing layer 130 may be further increased in a structure in which an interval between the external electrodes 150 is gradually decreased according to product miniaturization, thereby improving mountability in surface-mount technology (SMT).

The following Table 1 illustrates experimental data values of mountability of SMT and warpage in structures (exemplary embodiments 1 to 3) in which the reinforcing layer 130 is formed and structures (comparative examples 1 to 3) in which the reinforcing layer 130 is not formed, for each size by classifying a product group for each size.

Here, mountability of SMT indicates the number of test pieces stably mounted on the board without a solder bridge phenomenon when 100 test pieces of each type are mounted on the board, and warpage indicates a value obtained by measuring a distance from a center point of the insulating layer 120 to an inflection point of the insulating layer 120 after a reflow process.

TABLE 1

| No | Size | Product | Mountability of SMT | Warpage |
|---|---|---|---|---|
| 1 | 0806 | exemplary embodiment 1 | 100/100 | 120 μm |
| 2 | 0806 | comparative example 1 | 100/100 | 595 μm |
| 3 | 0605 | exemplary embodiment 2 | 100/100 | 254 μm |
| 4 | 0605 | comparative example 2 | 99/100 | 1489 μm |
| 5 | 0403 | exemplary embodiment 3 | 100/100 | 349 μm |
| 6 | 0403 | comparative example 3 | 48/100 | 3564 μm |

As can be seen from Table 1, in the case of comparative examples 1 to 3 in which the reinforcing layer 130 is not formed, as the product is miniaturized, the number of products stably mounted on the board may be reduced. Here, as the size of the product is decreased, the interval between the external electrodes 150 is decreased. It can be seen that the number of products stably mounted on the board is sharply reduced at the 0403 size. In addition, warpage occurring in 0403 sized chips may be increased by about six times as compared to 0806 sized chips.

In contrast, in the case of the exemplary embodiments 1 to 3 in which the reinforcing layer 130 is formed, it can be seen that all of the 100 test pieces are stably mounted regardless of size, and warpage is improved to a level of about 1/10, based on the 0403 sized chips, as compared to a case in which the reinforcing layer 130 is not formed.

Hereinabove, although a case in which the external electrodes 150 are provided as a lower surface structure has been described, the present disclosure may also provide a coil component in which the external electrodes 150 are provided as a side surface structure as another exemplary embodiment. A description thereof will be provided below with reference to FIG. 4.

Figure 4:
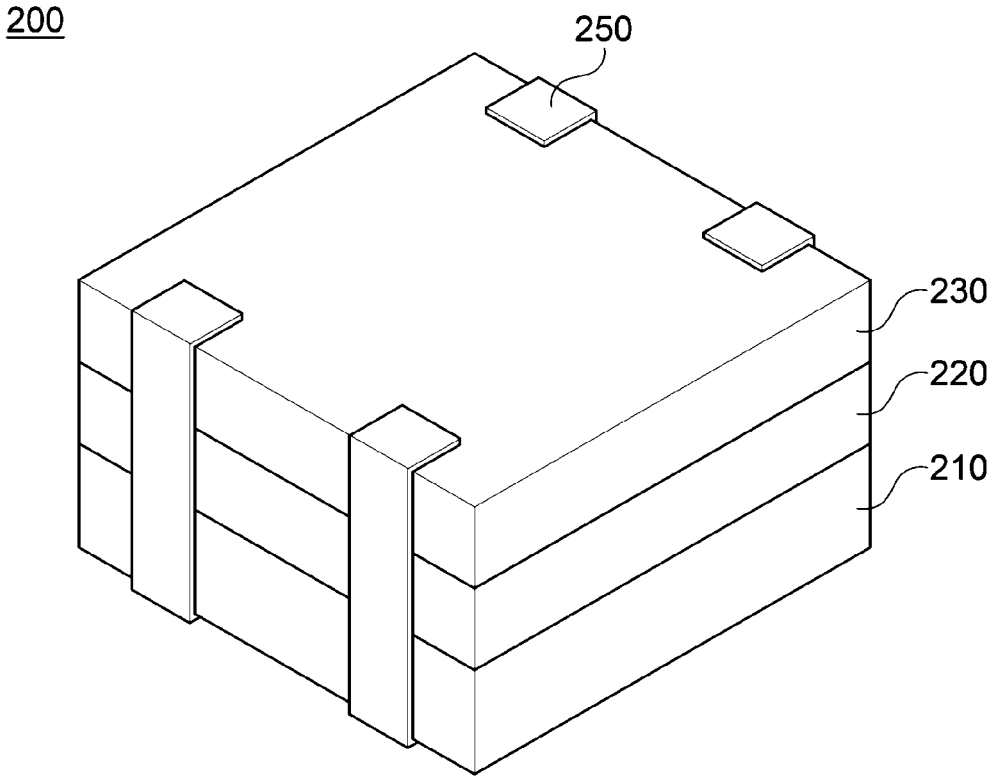
FIG. 4 is a perspective view of a coil component according to another exemplary embodiment in the present disclosure.

FIG. 4 is a perspective view of a coil component according to another exemplary embodiment in the present disclosure.

Referring to FIG. 4, a coil component 200 according to another exemplary embodiment in the present disclosure may have a structure in which a magnetic substrate 210, an insulating layer 220, and a reinforcing layer 230 are sequentially laminated from a lower portion of the coil component 200 as a basic element, similar to the exemplary embodiment described above. Although not illustrated in FIG. 4, a primary coil and a secondary coil, electromagnetically coupled to each other, may be installed in the insulating layer 220 as a multilayer structure or a simultaneous coil structure.

Here, since materials forming the magnetic substrate 210, the insulating layer 220, and the reinforcing layer 230, functions thereof, and the like are the same as those described above, a detailed description thereof will be omitted.

Both end portions of the primary coil and the secondary coil may be exposed to lateral surfaces of the insulating layer 220 and may be in contact with external electrodes 250. For instance, the external electrodes 250 may be formed as four terminals all serving as input and output terminals of the primary coil and the secondary coil. The external electrodes 250 may be installed on lateral surfaces of a multilayer body including the magnetic substrate 210, the insulating layer 220, and the reinforcing layer 230 and may be connected to end portions of the primary and secondary coils exposed externally.

Hereinafter, a method of manufacturing a coil component according to the present disclosure will be described.

Figure 5:
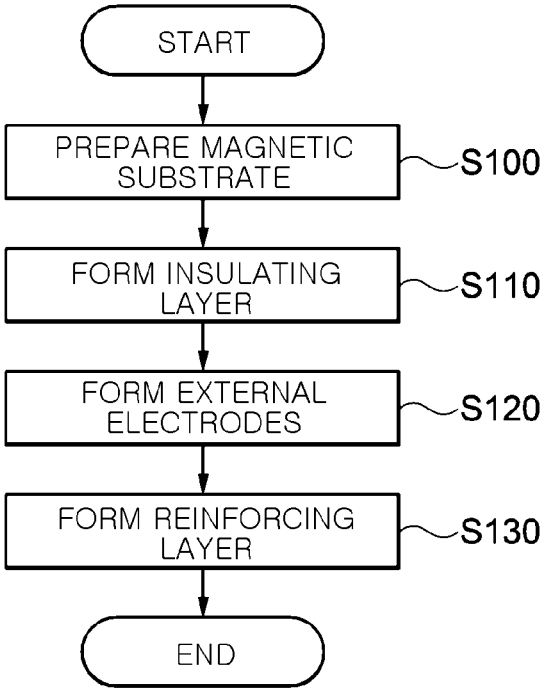
FIG. 5 is a flowchart sequentially illustrating a method of manufacturing a coil component according to an exemplary embodiment in the present disclosure.

FIG. 5 is a flowchart sequentially illustrating a method of manufacturing a coil component according to an exemplary embodiment in the present disclosure. In the method of manufacturing the coil component according to the present disclosure, first, an operation of preparing a magnetic substrate 110 manufactured by sintering a magnetic powder of a Ni-based ferrite material, a Ni—Zn-based ferrite material, or a Ni—Zn—Cu-based ferrite material under predetermined conditions may be performed (S100).

Next, an operation of forming an insulating layer 120 in which conductive coils 140 are embedded in the magnetic substrate 110 may be performed (S110).

To this end, an insulating material may be applied on an upper surface of the magnetic substrate 110 using a typical coating method such as a spin coating, or the like, and the conductive coils 140 may be formed on the insulating material by plating.

As a plating method of the conductive coils 140, a typical plating process which is known in the art, for example, a semi-additive process (SAP), a modified semi-additive process (MSAP), a subtractive method, or the like may be used. In a case in which the conductive coils 140 are formed on one layer, the insulating material covering the conductive coils 140 may be coated. In a case in which the above-mentioned process is repeated by the number of required layers of the conductive coils 140 and a sintering process is then performed, the insulating layer 120 in which the conductive coils 140 are embedded may be formed.

Next, external electrodes 150 having a predetermined thickness may be formed according to the plating method described above (S120), and in a case in which a mixed paste manufactured by milling a polymer resin and an inorganic filler 131 is provided between the external electrodes 150 and is then cured, the coil component 100 according to the present disclosure in which the reinforcing layer 130 is formed may be finally finished (S130).

As set forth above, according to the exemplary embodiments in the present disclosure, high attenuation characteristics and mountability may be improved and the deviation of the coefficient of thermal expansion between the components may be alleviated, whereby product defects such as warpage, or the like may be suppressed.

While exemplary embodiments have been shown and described above, it will be apparent to those skilled in the art that modifications and variations could be made without departing from the scope of the present invention as defined by the appended claims.

What is claimed is:

1. A coil component comprising:

a magnetic substrate;

an insulating layer on the magnetic substrate and having conductive coils formed in the insulating layer; and a reinforcing layer on the insulating layer and having a coefficient of thermal expansion lower than a coefficient of thermal expansion of the insulating layer, wherein the reinforcing layer is formed of a polymer resin or a mixture of the polymer resin and an inorganic filler, wherein the reinforcing layer has a composition different than that of the insulating layer, wherein the reinforcing layer is formed of a non-magnetic material, and wherein the magnetic substrate is formed of sintered ferrite.

2. The coil component of claim 1, wherein the coefficient of thermal expansion of the reinforcing layer is higher than a coefficient of thermal expansion of the magnetic substrate.

3. The coil component of claim 1, wherein the inorganic filler is any one selected from a group consisting of alumina ($Al_2O_3$), silica ($SiO_2$), and titanium oxide ($TiO_2$), or mixtures thereof.

4. The coil component of claim 1, further comprising external electrodes on an upper surface of the insulating layer and electrically connected to the conductive coils, wherein the reinforcing layer is between the external electrodes.

5. The coil component of claim 1, wherein the conductive coils comprise a primary coil and a secondary coil, electromagnetically coupled to each other.

6. The coil component of claim 1, wherein the coefficient of thermal expansion of the reinforcing layer is set in a range of 20 to 30 ppm/K.

7. A coil component comprising:

a magnetic substrate;

an insulating layer on the magnetic substrate and having conductive coils formed in the insulating layer;

a reinforcing layer on the insulating layer and having a coefficient of thermal expansion lower than a coefficient of thermal expansion of the insulating layer; and external electrodes on lateral surfaces of a multilayer body including the magnetic substrate, the insulating layer, and the reinforcing layer, and electrically connected to end portions of the conductive coils exposed to the lateral surfaces of the insulating layer, wherein the reinforcing layer is formed of a polymer resin or a mixture of the polymer resin and an inorganic filler, wherein the reinforcing layer has a composition different than that of the insulating layer, wherein the reinforcing layer is formed of a non-magnetic material, and wherein the magnetic substrate is formed of sintered ferrite.

8. The coil component of claim 7, wherein the coefficient of thermal expansion of the reinforcing layer is higher than a coefficient of thermal expansion of the magnetic substrate.

9. The coil component of claim 7, wherein the inorganic filler is any one selected from a group consisting of alumina ($Al_2O_3$), silica ($SiO_2$), and titanium oxide ($TiO_2$), or mixtures thereof.

10. The coil component of claim 7, wherein the coefficient of thermal expansion of the reinforcing layer is set in a range of 20 to 30 ppm/K.

* * * * *